US008587200B2

(12) United States Patent
Anderson et al.

(10) Patent No.: US 8,587,200 B2
(45) Date of Patent: Nov. 19, 2013

(54) EXTENDED OPTICS LED BULB

(76) Inventors: Leroy Anderson, Boise, ID (US); David Shaw, Boise, ID (US)

( * ) Notice: Subject to any disclaimer, the term of this patent is extended or adjusted under 35 U.S.C. 154(b) by 10 days.

(21) Appl. No.: 13/332,061

(22) Filed: Dec. 20, 2011

(65) Prior Publication Data

US 2013/0099665 A1 Apr. 25, 2013

Related U.S. Application Data

(60) Provisional application No. 61/425,138, filed on Dec. 20, 2010.

(51) Int. Cl.
*F21V 29/00* (2006.01)

(52) U.S. Cl.
USPC ..... 315/51

(58) Field of Classification Search
USPC ..... 315/51, 192–193, 46; 362/249.03, 362/249.06, 249.02, 249.11, 311.06, 362/311.08, 363, 186
See application file for complete search history.

(56) References Cited

U.S. PATENT DOCUMENTS

| | | | | |
|---|---|---|---|---|
| 7,344,279 | B2 * | 3/2008 | Mueller et al. | 362/294 |
| 7,845,823 | B2 * | 12/2010 | Mueller et al. | 362/231 |
| 8,314,566 | B2 * | 11/2012 | Steele et al. | 315/185 R |
| 2010/0172122 | A1 * | 7/2010 | Ramer et al. | 362/84 |

* cited by examiner

*Primary Examiner* — Minh D A
(74) *Attorney, Agent, or Firm* — Robert L. Shaver; Dykas & Shaver

(57) ABSTRACT

Disclosed is a light bulb which utilizes LEDs which replaces an incandescent light bulb in a fixture for incandescent light bulbs. The LED light bulb includes an optic which can be shaped to direct light to the side, and in different directions from the LED light source. Heat dissipation structures include a heat transfer column which extends from the LED to the base of the bulb, and fins which surround the optic or the support cone around the optic. A removable cover is enclosed which has openings for air circulation within the globe of the light bulb.

19 Claims, 7 Drawing Sheets

EXTENDED OPTICS LED BULB

PRIORITY/CROSS-REFERENCE TO RELATED APPLICATIONS

This application claims the benefit of U.S. Provisional Application No. 61/425,138, filed Dec. 20, 2010, the disclosure of which is incorporated by reference.

BACKGROUND

Light emitting diodes (LEDs) have been used in recent years in more and more lighting applications. Some have been used to light room lights, and even to operate in fixtures for conventional light bulbs. A problem with all LED lights is dissipating the heat from the LED itself. The heat from the LED is enough to easily destroy the LED itself unless it is conducted away from the LED so that the LED stays below the critical temperature of that particular model of LED. That critical temperature is typically above 200°. LED equipped light bulbs have dealt with the problem of dissipating in various ways. This can include making the output of the LEDs fairly low, having a large number of LEDs so that each one does not have to put out a lot of heat, and having various structures for dissipating heat. Improved ways of dissipating heat and making LEDs function to replace conventional incandescent light bulbs is therefore a desirable goal of a new product. The excellent ratio of light produced compared to energy spent making light make LEDs the lighting choice for the future, in all sorts of lighting situations, including room lighting.

SUMMARY OF THE DISCLOSURE

The invention is an LED light for use in standard light sockets, for room illumination. The device includes a bulb base connected to a globe base. The bulb base includes a conductive socket which screws into a standard light bulb socket. The bulb base also includes a first electrode at the tip of the base, and a second electrode which is in the sidewall of the bulb. These electrodes are configured to interact with a standard light bulb socket configured for incandescent bulbs.

The globe base is attached to the top of the bulb base and includes one or more LEDs placed on the disk-shaped globe base. The globe base has a flat top surface, which has a generally circular cross section. The LED light also includes a control circuit which includes electronic components for powering and regulating electricity to the LED light. The control circuit is located below the top surface of the globe base, and can be within the body of the globe base or within the central core of the bulb base. It is typically imbedded in a matrix of potting material which is injected as a liquid, which is heat conductive but not conductive of electricity, and which hardens into a solid. He globe base has holes which allow air to circulate from outside the globe to the interior of the globe.

At least one LED is positioned on the top of the globe base and is electrically connected to the first and second electrode in the bulb base. The LED is configured to emit light when energized, and one or more LEDs are in direct contact with the globe base.

The light also includes an optic which is positioned over the LED. The optic is made of a clear plastic material for optimum light transmittal. The optic has two general regions, which are directly connected to, and contiguous with each other, and seamlessly joined. The lower region has a generally conical outside profile, and the upper region is seamlessly connected to the lower portion and has a generally more tubular outside profile. Together they have the appearance generally of an inverted nose cone, with a cylindrical portion and a conical portion. The upper portion may have generally vertical walls, thus making the upper portion cylindrical. The outer wall of the upper portion may also have angled walls, or curved walls depending on the spread of light that is desired from the optic.

The lower portion of the optic is surrounded by a generally conical support cone, which has an identical but reverse shape to the conical lower portion. The support cone surrounds and supports the lower portion of the optic, but also provides an air space between the plastic of the optic, so that the entire shape of the lower portion of the optic is surrounded by a small air space.

On top of the top surface of the globe base may be a heat sink which is in contact with the optic support cone. The heat sink is comprised of multiple radiating fins which are in contact both with the globe base adjacent the LEDs and the sides of the optic support cone.

A globe is attached to the globe base, and includes air ventilation ports adjacent to the top of the globe base, and at least one air ventilation port at the apex of the globe. These ventilation ports are configured to permit air circulation of outside air into the globe interior, by which air passes over the radiator heat sink fins, and out the top of the globe through the ventilation ports. The globe is removable from the globe base.

The optic also has an inner profile which is recessed into the interior of the generally conical optic. The inner profile is also generally conical, and extends into the interior of the optic.

The optic may optionally have a recess in the tip of the conical lower portion which allows an LED to be inserted within the bottom tip of the optic. This recess can be generally cylindrical, or partly curved, and surrounds an LED cap.

The optic works with the LED to direct light in a pattern dictated by the shape of the optic. The lower portion of the optic is surrounded by an air space, and the angles of the optic are carefully selected so that it may utilize the principal of total internal reflectance (TIR) to optimize transmission of light and to also redirect the transmission of light into a preferred pattern. The principal of TIR is that when the light travels through a material, such as the plastic of the optic, when the light hits the edge of the optic if it is at an angle below a certain angle, and if the edge of the optic is bounded by a material which has a sufficiently different density such as the air space, 100% of the light striking the interface between the plastic and the air will bounce off of the plastic surface and be redirected within the plastic. Thus the plastic optic is quite a bit more efficient than a reflector would be. By the angled shape of the lower portion of the optic, light from the LED is either directed toward the top of the optic or if any light hits the side of the lower portion it bounces and is redirected towards the top of the optic.

The inner profile of the optic also presents surfaces in the plastic, which are adjacent to material of a different density (air) and thus if the angle of the light to the surface of the plastic is below an angle dictated by the physics of the plastic, the light will be reflected. If the angle of the light striking the edge of the plastic is higher than that angle, then the light will pass through the plastic into the air. Thus quite a bit of the light from the LED goes out the top of the optic. For some light paths, as it reaches the interface between the plastic and the air at the top of the optic it encounters several angles. This is the shape of the inner profile of the plastic. As light hits the inner profile of the plastic, if it is below a certain angle it bounces sideways and is reflected out the sides of upper portion of the optic. This side bouncing provides for a side spray of light and significant lateral spread of the light around the optic. The side spray of light vs. the out-the-top light path is controllable by the shape of the optic.

Some light also passes straight out the top end of the optic and provides for a conical spread of light above the optic, for instance. A band of light is bounced out the side of the optic and provides a 360 spread of light out the side of the globe.

The inner profile of the optic may include a flat region at the bottom of the inverted cone, or it may also include a bulged region at the bottom of the interior profile of the optic. Either of these provides for a different spreading of light, and may be adjusted depending on the spread of light which is desired for a particular bulb. Similarly the angles of the outside of the upper portion may be straight, may be bulged outward or inward, and may have different angles to the lower portion of the optic, in order to achieve the desired spread of light for a particular usage of bulb.

The bulb base and the globe base are connected to each other by a hollow core which is formed of a heat conductive column. This column is formed basically by filling the hollow core of the bulb base and the globe base with a heat conductive and electrical non-conductive column of material, the potting material mentioned above.

The light bulb can include a cylindrical radiator section which is positioned between the bulb base and the globe base and may include external fins or ridges around the radiator section for additional transmission of heat to the air surrounding the bulb.

The heat conducting column can be made of a potting material which is injected into the interior of the bulb to solidify inside the bulb and to surround the electronic components. The potting material can be made of any material that conducts heat well, but is non-conductive to electricity. This can include plastic materials, or plastic materials which are filled with particles of good heat conducting material. One way that this can be accomplished is by using particles or balls of copper or aluminum, which are excellent heat conductors but are also excellent conductors of electricity. The pieces, particles, or balls of aluminum or copper are first coated with a dielectric material, such as plastic, then may be mixed with liquid plastic and injected into the heat conducting column, where the liquid product can solidity. The particles or balls of copper or aluminum thus are insulated from electrical contact with each other, but contribute to enhanced heat transfer from warmer areas to colder areas.

The radiator fin extends from the cylindrical radiator section, and can be triangular, rectangular, or other shapes in cross section. The radiator fin or fins is/are configured to expel heat from the bulb. Preferably, the radiator section has more than one radiator fin, with an air space or groove between the radiator fins. The radiator section is also a heat sink, and may be machined, die cast, or stamped or made in any other conventional manner, with one or more radiating fins for providing additional surface area for dissipating heat to the atmosphere.

More than one LED can be utilized by the bulb. One type of an LED is a square LED which is subdivided into four separate LED sections. Other multi-LED units can be utilized, including units with four, nine, or other combinations of LED units.

The bulb also includes a printed electronic circuit, which is configured to control the functions of the LED light. This can include controlling the output, controlling the flow of electricity to the LED light, and functioning as an engine, a converter, a transformer, and /or a capacitor. The function of an engine in this context includes all of the elements necessary to provide an even and steady flow of electricity to the LED, including a transformer, capacitor, voltage regulator, and converter.

The air openings can include one or more in the globe base on which the LEDs are placed, openings in the side of the globe, and one or more near the top of the globe.

It is important to note that the entire extended lens length is surrounded by an air space. It is integral to the technology that the optic is surrounded by a material such as air space that has a sufficiently different density from PMMA plastic. This difference in density will cause 100% of the light striking the interface between the plastic and the air to bounce off of the plastic surface and be redirected back into the plastic, below a certain angle which is different for different materials. At above that angle, light passes out of the side of the optic and continues on. This principle is termed Total Internal Reflectance (TIR).

Standard-Use Light Bulbs for Home or Business Lighting have potential sales of 1.9 billion bulbs, in the U.S. alone (number of 60-watt incandescent light bulbs that will have to be replaced in the U.S. once the Energy Independence and Security Act takes effect in 2012). Many other countries have passed similar laws outlawing incandescents.

Standard LED light bulbs can use engineered optics to create a softer, more evenly distributed light. Current light bulbs use a beam of light emitted straight outward that only illuminates the center part of a room and excludes the far corners, in a case where the bulb is pointed straight down from the ceiling. This limitation causes inconvenience and possible safety risks. An optic can be engineered to reflect light rays in 360 degrees, thus enabling light to reach the far corners of a room. Optics can also create up to a 39 degree angle of downward illumination. Since the light beam would be less concentrated, it can create a softer light that is ideal for dining rooms, living rooms, and bathrooms. Conversely, a optic could be engineered to direct light in a particular direction to create a stronger light for offices and craft or task rooms Emergency lights are used in schools, office buildings, apartment buildings, churches and public buildings worldwide making their potential sales huge. Emergency stairway lighting can benefit from using optics to more effectively project light downward onto stairs where it is needed in an emergency situation. Many current stairway emergency lights waste their light by directing at least half of it upward toward the ceiling. An engineered optic would allow all the light emitted from emergency lights to go straight downward onto the stairs. An added benefit of using engineered optics with stairway emergency lights is that, since they use energy-efficient LEDs, the battery life would last 4 to 8 hours rather than the maximum 1.5 hours for incandescent bulbs.

There are three principal advantages of engineered optics: safety, lighting precision and energy efficiency. Engineered optics enhance safety by directing light beams away from where you do not need it and redirecting it where you do. A room light bulb using an engineered optic is the most precise lighting system available because they can be engineered to direct light in any exact direction or series of directions desired. Since the light is being reflected to the exact location desired, none of it is "wasted" by going elsewhere. In turn, this makes the light brighter where light it is needed most. Lastly, engineered optics are energy efficient because they use an LED light bulb that requires less energy and lasts longer than a CFL. Therefore, room light bulbs with engineered optics can be marketed as an innovative new product that is green, safe and economical.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept (s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

Figure 1:
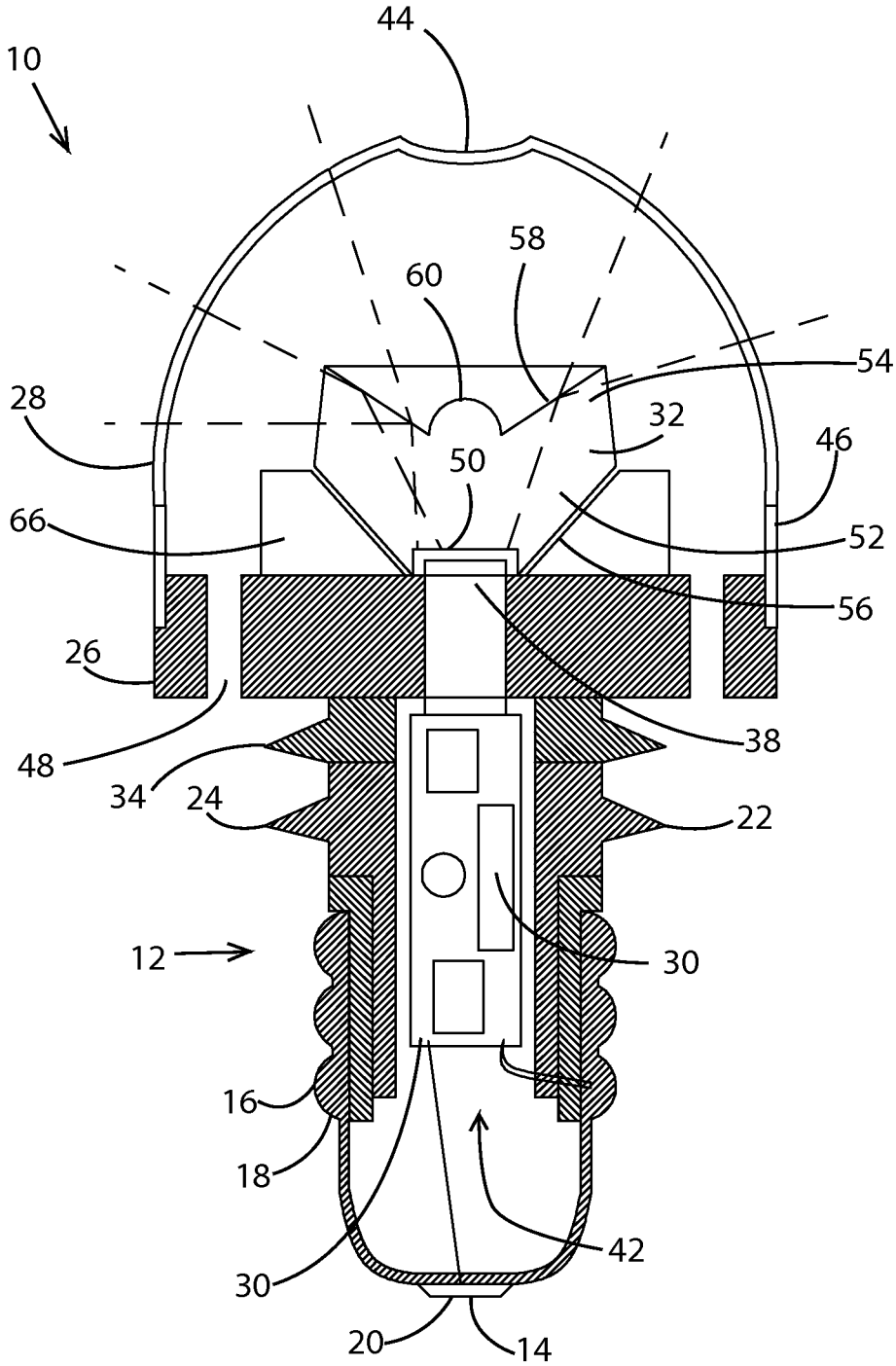
FIG. 1 is a cross section of the disclosed light bulb with optic.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Several preferred embodiments of the LED light bulb of the invention are shown in FIGS. 1 through 5.

FIG. 1 shows the LED light bulb 10 of the invention. It includes a bulb base 12 to which is attached a first electrode 14 and a second electrode 16. The second electrode 16 is electrically connected to the sidewall 18 of the bulb base. The bulb base 12 fits into a standard electrical socket for a light bulb. The bulb base 12 of the current invention thus connects the LED light bulb both physically and electrically to the electrical socket of a standard light bulb socket. Shown in FIG. 1 is the apex 20 of the light bulb.

Adjacent to the bulb base 12 is a radiator section 22 which includes at least one radiator ring 34 with a radiator fin 24. The radiator section 22 may include an additional radiator ring 34 which has an additional radiator fin 24. The radiator rings would preferably be made of aluminum, or another heat conducting material. Attached adjacent to the radiator section is a globe base 26. The globe base 26 would also be made of aluminum or another heat conducting material with similar properties to aluminum. The bulb base 12, the radiator rings 34, and the globe base 26, all define an interior column 42, in one preferred embodiment. As shown in FIG. 1, the column is a hollow portion that extends through all of these pieces. The column is capped by the globe base 26, on which is mounted an LED light source 38 and an optic which controls the spread of light from the LED. Inside the column 42 is positioned a control circuit board 30. The control circuit board 30 could also be positioned inside the globe base 26. Mounted on this control circuit board are the components that are typically required to power an LED light. These components can include a converter, a transformer, a capacitor, and a power selector. For instance, a selected LED light can be operated at different milliamps, and the power output in milliamps can be selected on the control board, or on a switch attached to the control board.

The column 42 shown in FIG. 1 is depicted as being hollow, but in the manufacturing process it would be filled with a liquid material which solidifies into a solid. Thus, the column 42 would be completely filled by solid material, preferably a type of epoxy or silicone which is nonconductive of electricity but which is conductive of heat.

Also shown in FIG. 1 is a globe 28 which is removably attached to the globe base 26. The attachment of the globe to the globe base can be by a friction mount, threaded, twist lock or other conventional attachment means. Shown in FIG. 1 is a first air hole 44 which is defined in the top of the globe 28, and also depicted is a second hole 46 in a lower portion of the globe 28, and a ventilation hole 48 in the globe base 26. Additional heat transfer can include the globe base being covered with copper or made of solid copper adjacent the LED. Since copper is electrically conductive, the LED must be attached to a nonelectrically conductive surface like an LED insulator pad. Something like a double sided tape works for this application.

A suitable type of material to form the column 42 of the invention is a product called TCR, made by Electrolube. It is a thermal transfer material and provides excellent thermal conductivity and cures at room temperature without an oil residue. RTV stands for Room Temperature Vulcanizing, and these materials are typically silicone based and contain a proprietary mix of mineral fillers which aid in heat conduction.

A type of LED which has proven successful is an LED that operates between 300 milliamps and 750 milliamps. A switch on the device can be used to adjust the intensity of light output for this reason. It is to be understood that this is merely one example of a suitable LED, and the invention is made to be useful with any number of LEDs, depending on the particular application that a particular bulb is designed for.

The TIR optic of the invention includes a generally cylindrical LED pocket in an apex of the cone portion of the TIR, which fits around the LED light cover and the LED light source.

When designing an extended TIR optic 10 of the disclosed technology, it is sometimes easier to reverse engineer the optic. First, decide where you want the light to go, and then determine the angle of refraction and the angle of recedence for a number of light beams. This will determine the distance of the extension for the optic and the angle for the reflector surface.

The figures include a number of optic shapes which achieve this purpose, that of shaping the light to have all of the light from an LED light source through an optic with the light directed straight out, or with different amounts of spread to the side.

FIG. 1 shows a version of the LED will light in which a support cone 66 surrounds an optic 32. The optic 32 has an LED pocket 50 at its base, which fits over an LED light source 38. The optic shown in FIG. 1 has an optic lower region 52 which is generally cone shaped. Attached to the cone shaped portion of the optic is optic upper region 54 in this version of the optic, the upper region is generally cylindrical on the outside, and has an internal depression on its top surface. The internal depression is generally conical and has a protruding bulge in its center. The purpose of the shapes is to serve as reflecting surfaces and transmitting surfaces for light which emanates from the LEP 38. Between the support cone 66 and the optic 32 is an airspace.

Figure 2:
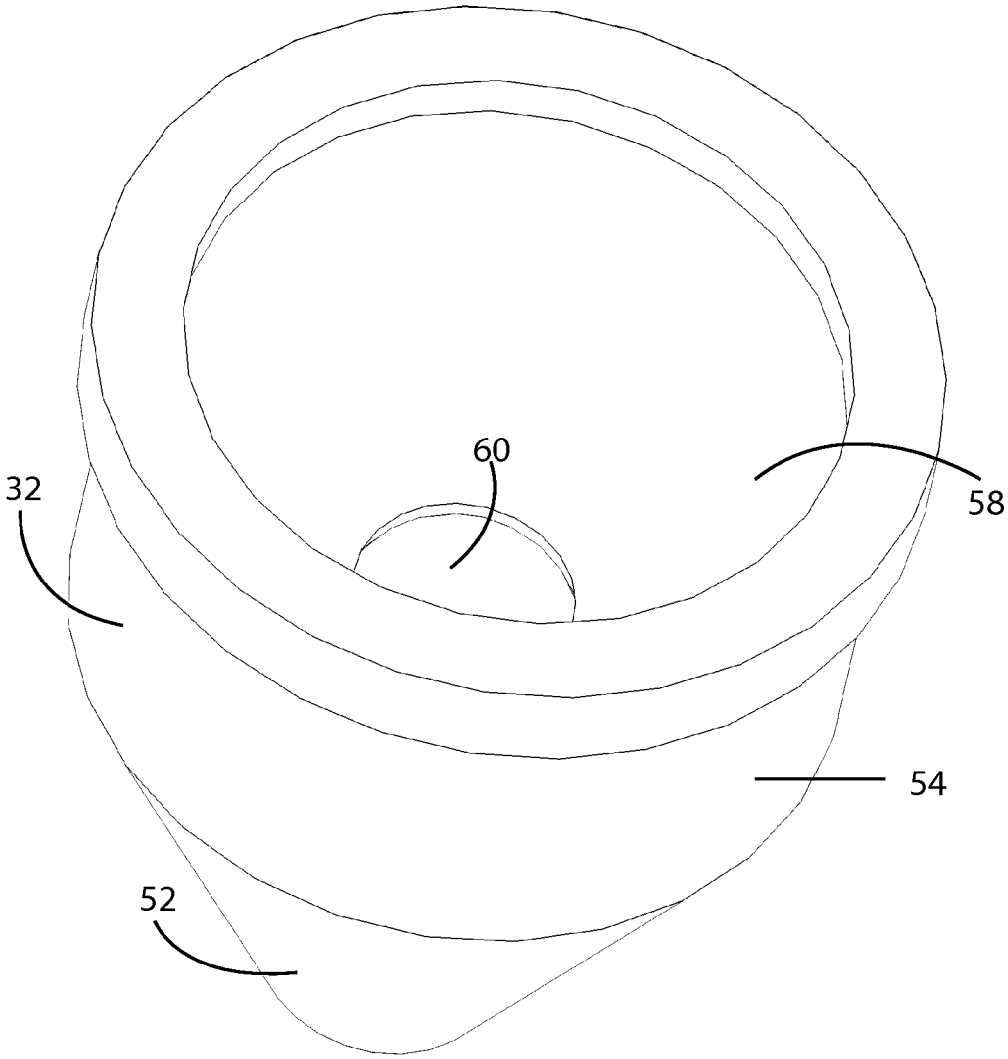
FIG. 2 is a perspective view of a view of an example shape of optic.

FIG. 2 shows a perspective view of an optic 32 which has a conical optic lower region 52 to which is attached to an optic upper region 54 which is generally cylindrical in shape. This version of the optic has an inner top surface 58 which is generally concave. In the center of the inner curved top surface 58 is a light dispersion surface, which could take varying shapes the pending on the spread of light which is desired. In the version shown in FIG. 2 the light dispersion surface 60 is flat, but as shown in FIG. 1, it could also be convex.

Figure 3:
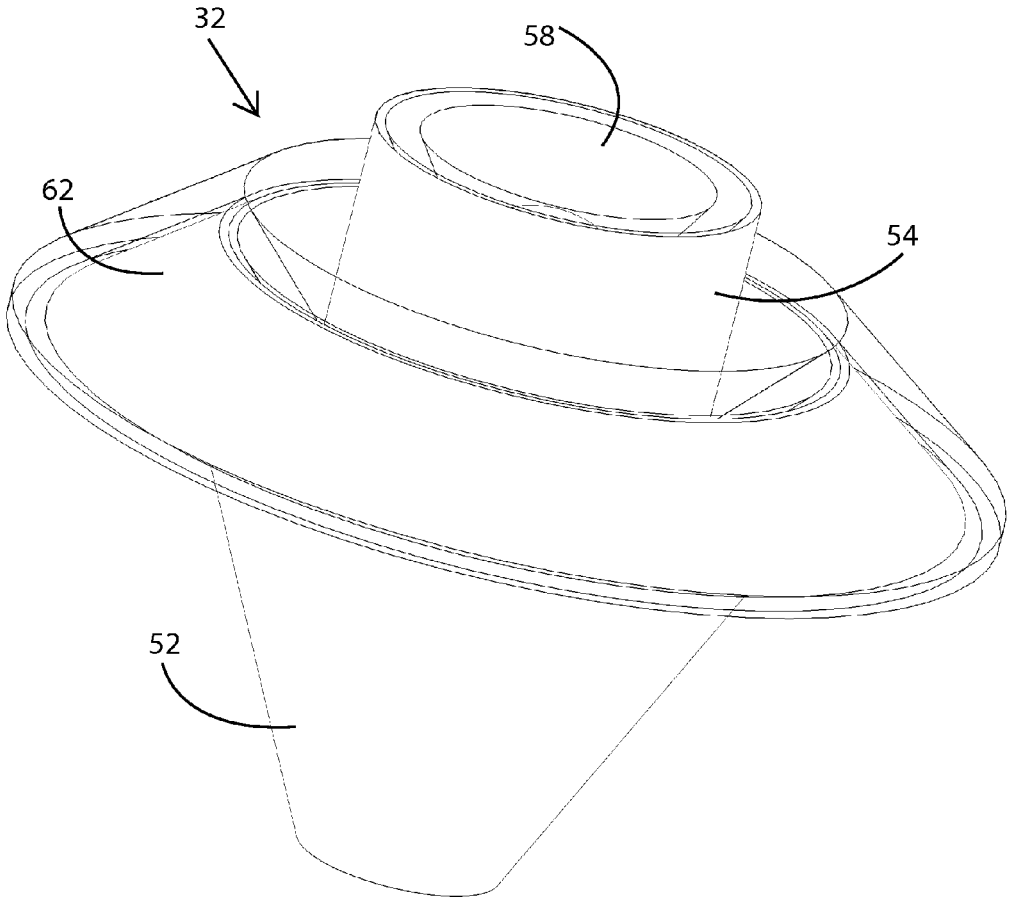
FIG. 3 is a perspective view of a view of an example shape of optic.
Figure 4:
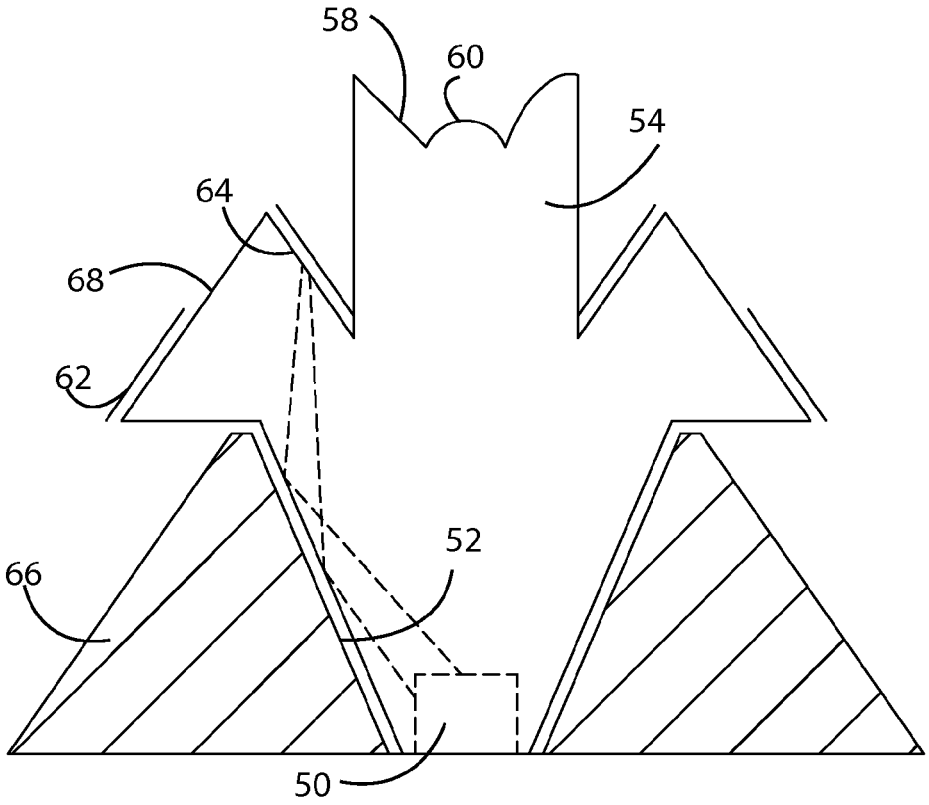
FIG. 4 is a side cross section view of side spill optic plus top spreading optic.

FIG. 3 shows another version of the optic 32 which has a generally conical optic lower region 52 with a light dispersing skirt 62 in the optic upper region. The light dispersing skirt combined with light reflection structures of the upper optic region 54 result in some of the light in the center part of the optic being reflected out through the edges of the skirt 62. Centered in the optic shown in FIG. 3 is an upper optic region 54. This upper part of the optic has a shape similar to that shown in FIG. 1, and has a generally cylindrical sidewall with a concave and generally conical inner top surface 58. The inner top surface 58 can have a light dispersion surface in its middle, which can be flat or convex depending on the desired spread of light. FIG. 4 shows a side cross-sectional view of the optic shown in FIG. 3. Version shown in FIG. 4 shows a support cone 66, which can be a heat dissipating material. The optic of FIG. 4 has an LED pocket 50, which sits over an LED on the globe base. The version of the optic shown in FIG. 4 has a light dispersing skirt 62 which has an upper wall 64 which serves as a reflecting surface for light from the LED. As shown in the figures, a beam of light from the LED could hit the sidewall of the optic lower region 52 in balance into the upper wall 64 and out the side edge 68 of the skirt.

The total internal reflectance effect is triggered by a difference in the density of materials, so each of the surfaces of the cone has an air space around it so that light is either reflected back and or passes through the plastic depending on the angle of the light. The purpose of the design of the optic of FIGS. 3 and 4 is to provide a structured which spreads light to the side of the light bulb. This shape of optic might be selected for special purposes and which of this 360° spread of light would be appropriate. The optic shown in FIGS. 3 and 4 also has an upper optic region 54 with additional light reflecting surfaces. The general shape of the upper part of this optic is similar to the shape of the optic in FIG. 1, with an inner top surface with a central light dispersion surface 60.

Figure 5:
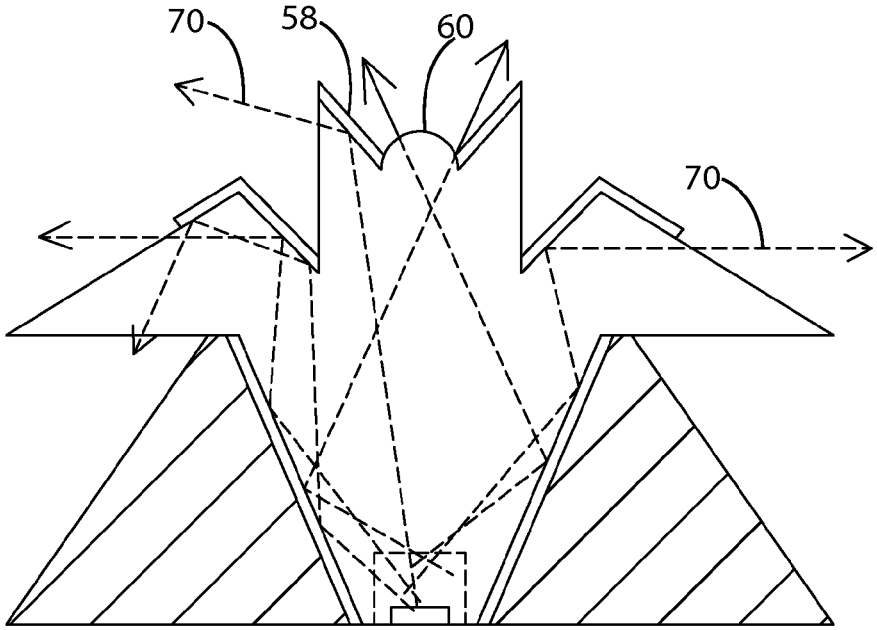
FIG. 5 is a side cross section view of a side spill plus top spreading optic.

FIG. 5 is an optic 32 which would be placed on the globe base 26 of the bulb similar to that shown in FIG. 1. This version of the optic is similar to the optic of FIG. 4, and shows some examples of light paths 70 which this optic would produce. As shown in FIG. 5, the shape of this optic would produce light paths with light directed 360° around the optic when viewed from above the optic, and in a spread of more than 180 degrees when viewed from the side as in the view of FIG. 5. Some of the light paths 70 are directed in a downward direction. On the upper end of the optic, the light dispersion surface 60 has an inner top surface 58 which results in a further dispersion of light from the optic.

Figure 6:
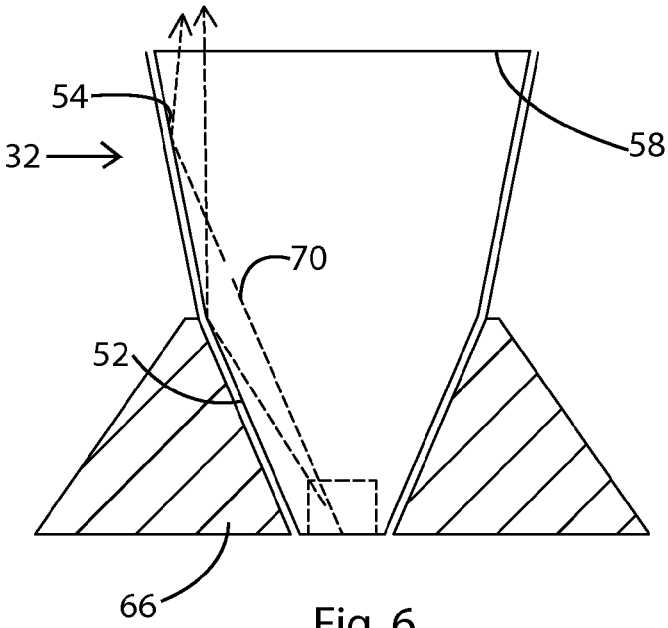
FIG. 6 is a side view of an optic for delivering a spot light beam.

FIG. 6 shows another possible configuration of the optic 32 which would be used in conjunction with the light bulb base of FIG. 1. Shown in this view of an alternative optic shape is a optic lower region 52 and upper optic region 54, with the lower optic region being surrounded by support cone 66. In this case the inner top surface 58 of the optic upper region 54 is flat. An exemplary light path 70 is shown illustrating that the typical light path from the LED would result in light being directly directed out the top surface 58 of the optic. This would result in a in a spot light shaped beam, and would be used in situations where a spotlight would be appropriate.

Figure 7:
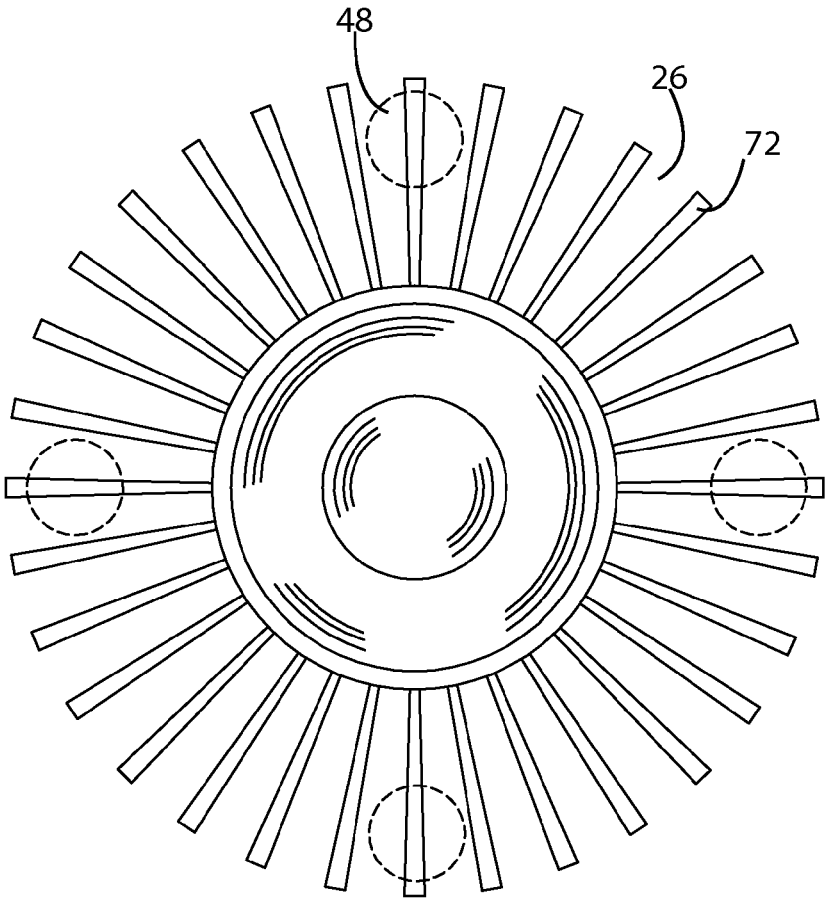
FIG. 7 is a top view of an array of radiator fins adjacent to an optic.

Shown in FIG. 7 is an array of radiator fins 72 which are an optional feature for use in any of these optics. These radiator fins 72 would be in contact with the globe base 26 and would be cooled by the vent holes 48 in the globe base as well as the air holds 46 in the side of the globe 28. The radiator fins 72 could be in direct contact with the support cone 66, or the internal side of the radiator fins 72 could form a support cone 66 adjacent to the optic 32.

An advantageous configuration of the radiator fins 72 would be one in which multiple vent holes 48 are positioned between fins, with alternate fins being adjacent to air holes 46 in the side of the globe 28. One configuration would be one in which each radiator fins 72 had one of these types of air holes on each side of the radiator fan, for optimal cooling.

Figure 8:
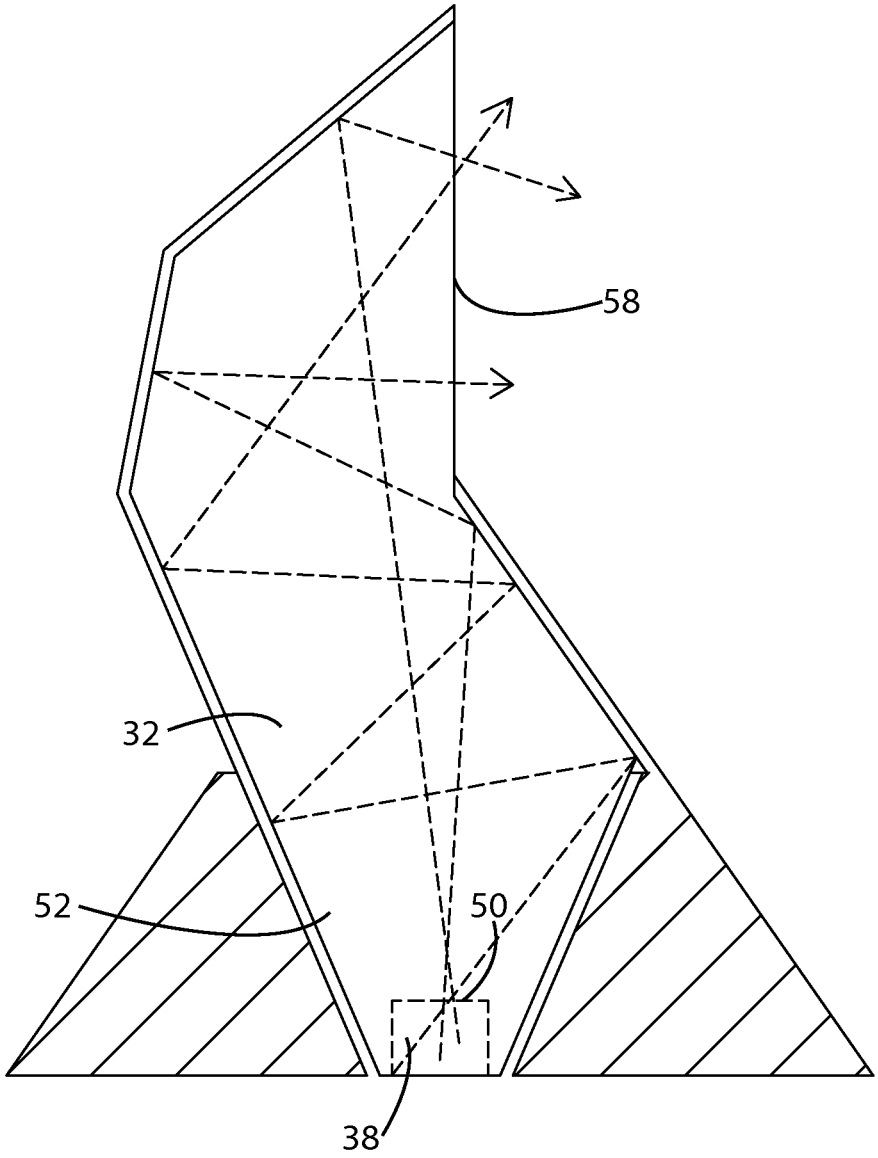
FIG. 8 is a side cross section view of an optic for emitting a rectangular beam of light 90 degrees from the light emitted from the LED.

FIG. 8 shows a version of the optic 32 which is configured to direct light generally 90° from the output of the LED light 38. In this case the LED light 38 fits in the LED pocket 50, and the light paths 70 from the LED 38 enter the optical lower region 52 and are reflected against the various sides of the optic until they exit out the top surface 58, which is pointed at an approximately 90° angle to the original direction of the light from the LED.

Figure 9:
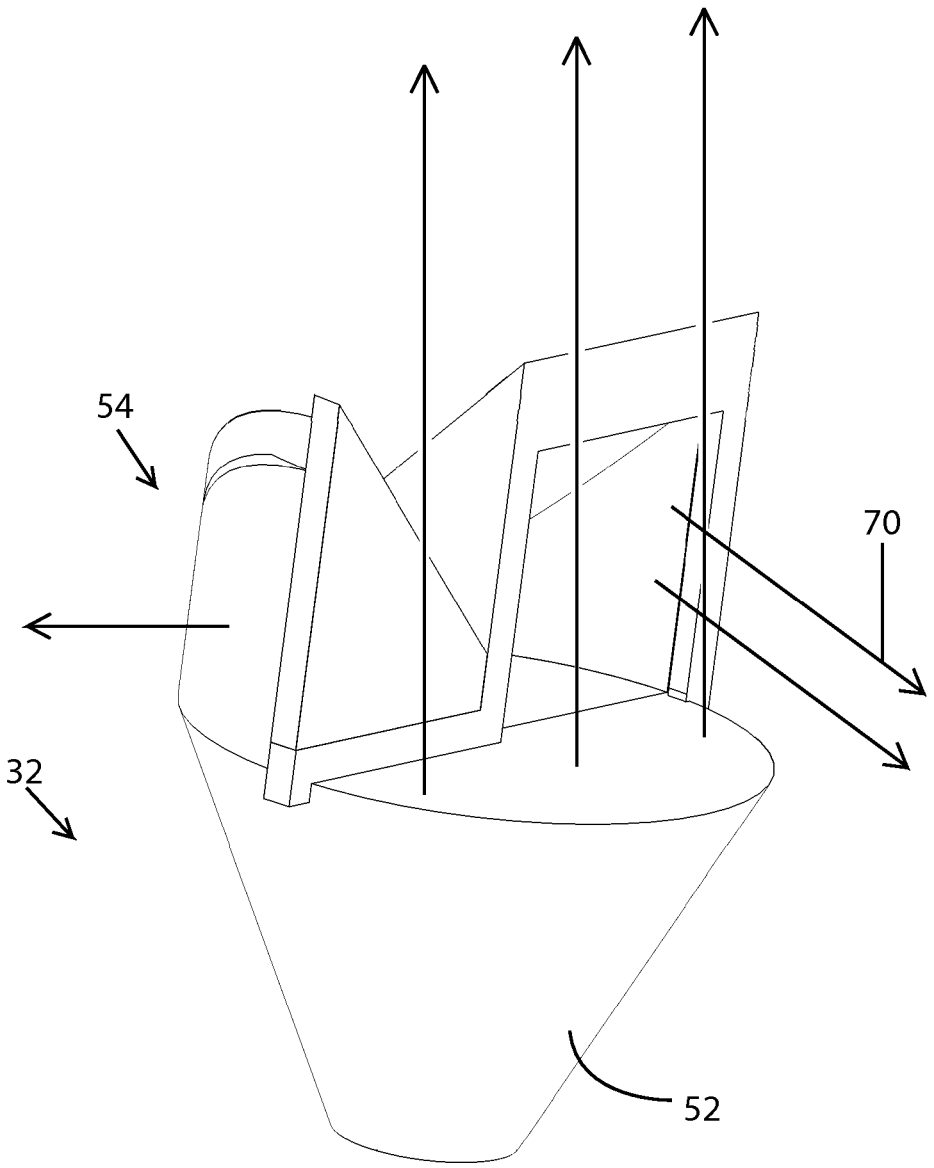
FIG. 9 is a perspective view of an optic for directing light in multiple directions.

FIG. 9 shows how one version of an optic which is configured to spread light in an asymmetrical pattern could be constructed. This version of the optic 32 includes an optical lower region 52. The upper region 54 is made up of several structures with angles of the optic to provide for reflecting and directing light in predetermined directions. In the case shown in FIG. 10, light paths 70 are directed in a generally horizontal manner, approximately 90° from the direction of the light from the LED in the globe, and the light bean can be rectangular in shape. A panel shown on the left of the optic shows a light path 70 being spread in a side direction from the original direction of light from the optic. Some light paths 70 are also shown which travel generally straight out from the LED, and provide illumination directly above the optic as shown in FIG. 10.

These different light beams emanating from a single LED are combined in the invention to good advantage by having each LED directed in a different direction. This allows light from a single bulb to throw several beams of intense white light in different directions surrounding the bulb, to create a bulb which has excellent ability to light a room.

While certain exemplary embodiments are shown in Figures and in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. An LED light bulb for use with a socket for incandescent bulbs, comprising:

a bulb base, comprising a conductive socket with a first electrode at an apex of said socket, and a second electrode in electrical connection with a sidewall of said bulb base, with said electrodes configured to physically and electrically engage a standard light bulb socket configured for incandescent bulbs;

a globe base attached to said bulb base, said globe base configured for attachment of a globe, said globe serving to protect one or more LEDs from contact with foreign objects with said globe base having heat sink and heat transfer properties;

a control circuit including electronic components for powering and regulating electricity to an LED light;

at least one LED positioned inside said globe on said globe base, with said LED electrically connected to said first and second electrode by electrical connections, and configured to emit light when energized, with said LED in thermal contact with said bulb base, and said globe base;

an optic positioned over said LED, the optic comprising a lower portion with a generally conical outside profile, and an upper portion with a generally cylindrical outside profile, with said optic lower portion surrounded and supported by a support cone with a conical interior cavity, with an air space defined between said support cone and said optic lower portion;

said globe comprising air ventilation ports adjacent to said globe base, and at least one globe top air ventilation port, configured to permit air circulation of outside air into said globe interior, over said radiator heat sink fins, and out said globe top ventilation ports.

2. The LED light bulb of claim 1 which further comprises a plurality of radiator fins in contact with said support cone, said radiator fins extending from said support cone and in contact with said globe base.

3. The LED light bulb of claim 1 which further comprises a plurality of radiator fins in contact with said optic lower portion, said radiator fins extending from said support cone and in contact with said globe base.

4. The LED light bulb of claim 1 in which said optic further comprises an LED pocket defined in the tip of said optic lower portion.

5. The LED light bulb of claim 1 in which said bulb base and said globe base define a hollow core which surrounds a heat conductive/electricity non-conductive column, with said column having a base end and an LED end, said column in thermal contact with said LED light, and with said LED mounted on said LED end of said heat conductive column.

6. The LED light bulb of claim 1 which further comprises a generally cylindrical radiator section positioned between and attached to both said bulb base and said globe base, said radiator section with at least one generally circular radiator fin, said radiator section configured to surround said heat conductive column and to expel heat from said bulb.

7. The LED light bulb of claim 6 in which said heat conducting column is comprised of heat conductive and electricity non-conductive potting material, said potting material in thermal contact with said LED, said radiator heat sink, and said radiator section, for insulating said electrical connections from electricity, and for conducting heat from said LED to said radiator section.

8. The LED light bulb of claim 6 in which said radiator section is comprised of two of more adjacent radiator rings with radiator fins.

9. The LED light bulb of claim 1 in which said globe is removable from said globe base.

10. The LED light bulb of claim 1 in which said control circuit is mounted on a circuit board positioned in said globe base.

11. The LED based light bulb of claim 1, in which said electronic circuitry is configured to function as one or more devices selected from the list consisting of an engine, a converter, a transformer, and a capacitor.

12. The LED based light bulb of claim 1, in which said optic comprises a flattened skirt area and side reflecting surfaces, in addition to said upper portion with a generally cylindrical outside profile, with said optic defining an inner profile which is generally conical, for projecting a band of light in a 360 degree band around the sides of the globe, as well as a cone of light projecting out the top of the globe.

13. The LED based light bulb of claim 1, in which said globe base further comprises at least one air passage extending from outside the globe to the interior of the globe.

14. The LED based light bulb of claim 1, with said optic defining an inner profile in said optic upper portion, which is generally conical and forms a convex depression in said optic upper portion.

15. The LED light bulb of claim 1 in which said optic conical inner profile further comprises a flat region directly over said LED at the bottom of said conical inner profile.

16. The LED light bulb of claim 1 in which said optic conical inner profile further comprises a convex region directly over said LED at the bottom of said optic inner profile.

17. The LED based light bulb of claim 1, in which said optic comprises a flattened skirt area and side reflecting surfaces, in addition to said upper portion with a generally cylindrical outside profile, with said optic defining an inner profile which is generally conical, for projecting a band of light in a 360 degree band around the sides of the globe, as well as a cone of light projecting out the top of the globe.

18. An LED light bulb for use with a socket for incandescent bulbs, comprising:

a bulb base, comprising a conductive socket with a first electrode at an apex of said socket, and a second electrode in electrical connection with a sidewall of said bulb base, with said electrodes configured to physically and electrically engage a standard light bulb socket configured for incandescent bulbs;

a globe base attached to said bulb base, said globe base configured for attachment of a globe, said globe serving to protect one or more LEDs from contact with foreign objects with said globe base having heat sink and heat transfer properties;

a control circuit including electronic components for powering and regulating electricity to an LED light;

at least one LED positioned inside said globe on said globe base, with said LED electrically connected to said first and second electrode by electrical connections, and configured to emit light when energized, with said LED in thermal contact with said bulb base, and said globe base;

an optic positioned over said LED, the optic comprising a lower portion with a generally conical outside profile, and an optic upper portion with a generally cylindrical outside profile, said optic defining an inner profile in said optic upper portion, which is generally conical and forms a convex depression in said optic upper portion, with said optic lower portion surrounded and supported by a support cone with a conical interior cavity, with an air space defined between said support cone and said optic lower portion;

said globe comprising air ventilation ports adjacent to said globe base, and at least one globe top air ventilation port, configured to permit air circulation of outside air into said globe interior, over said radiator heat sink fins, and out said globe top ventilation ports.

19. The LED based light bulb of claim 18, in which said optic comprises a flattened skirt area and side reflecting surfaces, in addition to said upper portion with a generally cylindrical outside profile, with said optic defining an inner profile which is generally conical, for projecting a band of light in a 360 degree band around the sides of the globe, as well as a cone of light projecting out the top of the globe.

* * * * *